United States Patent [19]

Wright et al.

[11] Patent Number: 4,870,910

[45] Date of Patent: Oct. 3, 1989

[54] WASTE INCINERATION METHOD AND APPARATUS

[75] Inventors: Kenneth C. Wright, Sapulpa; Jerry L. Stuck, Tulsa, both of Okla.

[73] Assignee: John Zink Company, Tulsa, Okla.

[21] Appl. No.: 301,452

[22] Filed: Jan. 25, 1989

[51] Int. Cl.[4] ..... F23N 5/02

[52] U.S. Cl. ..... 110/190; 110/188; 110/214; 110/345

[58] Field of Search ..... 110/188, 190, 214, 345

[56] References Cited

U.S. PATENT DOCUMENTS

| | | | |
|---|---|---|---|
| Re. 31,046 | 10/1982 | Lombana et al. | 110/187 |
| 3,267,890 | 8/1966 | Zinn et al. | 110/18 |
| 3,511,194 | 5/1970 | Stookey | 110/8 |
| 3,595,181 | 7/1971 | Anderson et al. | 110/8 A |
| 3,601,069 | 8/1971 | Mancuso | 110/190 |
| 3,670,667 | 6/1972 | Faurholdt | 110/8 A |
| 3,736,888 | 6/1973 | Lomax | 110/8 A |
| 3,792,671 | 2/1974 | Woods | 110/8 R |
| 3,807,325 | 4/1974 | Stearns | 110/190 |
| 3,837,302 | 9/1974 | Bersier | 110/190 |
| 3,861,334 | 1/1975 | Stockman | 110/190 R |
| 4,013,023 | 3/1977 | Lombana et al. | 110/8 A |
| 4,050,389 | 9/1977 | von Dreusche, Jr. | 110/12 |
| 4,270,467 | 6/1981 | Drake | 110/216 |
| 4,279,208 | 7/1981 | Guillaume et al. | 110/346 |
| 4,438,705 | 3/1984 | Basic, Sr. | 110/235 |
| 4,474,121 | 10/1984 | Lewis | 110/346 |
| 4,517,906 | 5/1985 | Lewis et al. | 110/346 |
| 4,827,855 | 5/1989 | Koptis et al. | 110/214 X |

*Primary Examiner*—Edward G. Favors

*Attorney, Agent, or Firm*—Laney, Dougherty, Hessin & Beavers

[57] ABSTRACT

An improved method and apparatus for incinerating successive batches of waste material are provided wherein each batch is introduced into a primary combustion zone and substochiometrically combusted with air introduced therein, the combustion gases produced in the primary combustion zone are conducted to a secondary combustion zone wherein they are combined with secondary air and further combusted and the combustion gases produced in the secondary combustion zone are withdrawn therefrom. By the present invention, the rate of secondary air combined with the combustion gases in the secondary combustion zone is controlled to maintain the combustion gases withdrawn therefrom at a substantially constant selected temperature level during the peak incineration stage of each waste batch. During the loading, initial and final incineration stages of each batch, if the selected temperature level cannot be maintained, the rate of secondary air is controlled in accordance with a predetermined timed sequence which simulates the increase and decline in the rate and combustibility of the combustion gases conducted to the secondary combustion zone during the loading, initial and final incineration stages of each waste batch.

15 Claims, 7 Drawing Sheets

WASTE INCINERATION METHOD AND APPARATUS

BACKGROUND OF THE INVENTION

1. Field of the Invention

The present invention relates to an improved waste incineration method and apparatus wherein successive batches of waste are substochiometrically combusted in a primary zone and then further combusted in a secondary zone with excess air to prevent the formation of smoke.

2. Brief Description of the Prior Art

Successive batch incineration methods and apparatus which utilize substochiometric combustion in a primary combustion zone followed by additional combustion with excess secondary air in a secondary combustion zone to insure complete combustion and the elimination of smoke, fumes and odors have been developed and used heretofore. While various techniques have been utilized for controlling the rates of primary and secondary air introduced into the primary and secondary combustion zones, such techniques have generally suffered from the disadvantage that the rate of secondary air is too high and overcooling of the combustion gases and secondary combustion zone take place during loading and during the time during the incineration of each batch of waste material when the secondary combustion chamber is below operating temperature. Such overcooling is uneconomical in that it wastes heat which must be replaced by the burning of extra auxiliary fuel or other means.

Incinerators including primary and secondary combustion chambers have often heretofore utilized temperature control instruments to control the rates of both the primary and secondary air. That is, a primary temperature controller senses the temperature of the combustion gases exiting the primary combustion chamber and adjusts the primary air rate accordingly to control the temperature of the combustion gases at a selected level. In a like manner, a secondary temperature controller senses the temperature of the combustion gases withdrawn from the secondary combustion chamber and adjusts the rate of secondary air to maintain the temperature of such gases at a relatively high selected temperature level. When such incinerators are being operated intermittently, i.e., time delays are incurred between batches of waste material or between groups of batches of waste material being incinerated, such high temperature level of the gases withdrawn from the secondary combustion chamber often cannot be maintained and overcooling takes place. That is, because the maximum rate and combustibility of combustion gases conducted to the secondary combustion chamber occur during the peak incineration stage of each waste batch, the temperature of the combustion gases produced in the secondary combustion chamber cannot be maintained at the selected high temperature level during the loading, initial incineration step and final incineration stage of each waste batch. Thus, when the temperature of the combustion gases produced in the secondary combustion chamber is below the selected temperature level as a result of intermittent incinerator operation and the rate and combustibility of the combustion gases conducted to the secondary combustion chamber being too low during the loading, initial incineration and final incineration stages of each waste batch, it has heretofore been the practice to simply maintain the rate of secondary air at a constant relatively high level to insure complete combustion and prevent the formation of smoke during such stages. This results in the overcooling of the combustion gases and incinerator apparatus. As mentioned, such overcooling is uneconomical in that it wastes heat. The overcooling is particularly disadvantageous where the combustion gases from the secondary combustion chamber are utilized as a heat source in a downstream system such as a steam generator or space heater.

Thus, there is a need for an improved incineration method and apparatus whereby overcooling in the secondary combustion zone which brings about the waste of heat does not take place, and the combustion gases withdrawn from the secondary combustion zone are maintained at a high overall temperature level during the incineration of each batch without the formation of smoke.

SUMMARY OF THE INVENTION

By the present invention the above-described need is met, i.e., an improved incineration method and apparatus are provided whereby during intermittent incinerator operation the combustion gases withdrawn from the secondary combustion zone during the incineration of each waste batch are maintained at a high overall temperature level while the formation of smoke is prevented.

In accordance with the method of this invention, successive batches of waste material are introduced into a primary combustion zone wherein substochiometric combustion with primary air takes place. The combustion gases produced in the primary combustion zone are conducted to a secondary combustion zone wherein they are combined with secondary air and further combusted, and the resulting combustion gases are withdrawn from the secondary combustion zone. The rate of primary air introduced into the primary combustion zone is controlled in accordance with changes in the temperature of the combustion gases produced therein whereby such temperature is maintained at a substantially constant selected level. The rate of secondary air introduced into and combined with the combustion gases in the secondary combustion zone is controlled in accordance with changes in the temperature of the combustion gases produced in the secondary combustion zone whereby such temperature is maintained at a substantially constant selected level during the peak incineration stage of each waste batch. When the selected temperature level cannot be maintained as a result of the rate and combustibility of the combustion gases conducted to the secondary combustion zone being too low during the loading stage, the initial incineration stage and the final incineration stage of each waste batch, the rate of secondary air is controlled in accordance with a predetermined timed sequence which simulates the increase and decline in the rate and combustibility of the combustion gases conducted to the secondary combustion zone during such stages. The predetermined timed secondary air rate control maintains the temperature of the combustion gases produced in the secondary combustion zone during the loading stage, the initial incineration and final incineration stage of each waste batch at a relatively high level, i.e., overcooling of the combustion gases and apparatus does not take place, but enough air is provided to prevent the formation of smoke. Apparatus for carrying out the method is also provided by the present invention.

It is, therefore, a general object of the present invention to provide an improved waste incineration method and apparatus.

A further object of the present invention is the provision of an improved method and apparatus for incinerating successive batches of waste material wherein overcooling of the combustion gases in the secondary combustion zone does not take place.

Yet a further object of the present invention is the provision of a method and apparatus for incinerating successive waste batches wherein the gases produced in the secondary combustion zone are maintained at a high temperature level and the formation of smoke, fumes and odors is prevented.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 3 is a schematic view of a controller for reducing the rate of secondary air in accordance with a predetermined timed sequence in the standby mode. FIGS. 4–8 are schematic illustrations similar to FIG. 3 showing the various operation modes of the controller after receiving an input signal indicating that the temperature of the combustion gases withdrawn from the secondary combustion zone is below a set point.

DETAILED DESCRIPTION OF PREFERRED EMBODIMENTS

Figure 1:
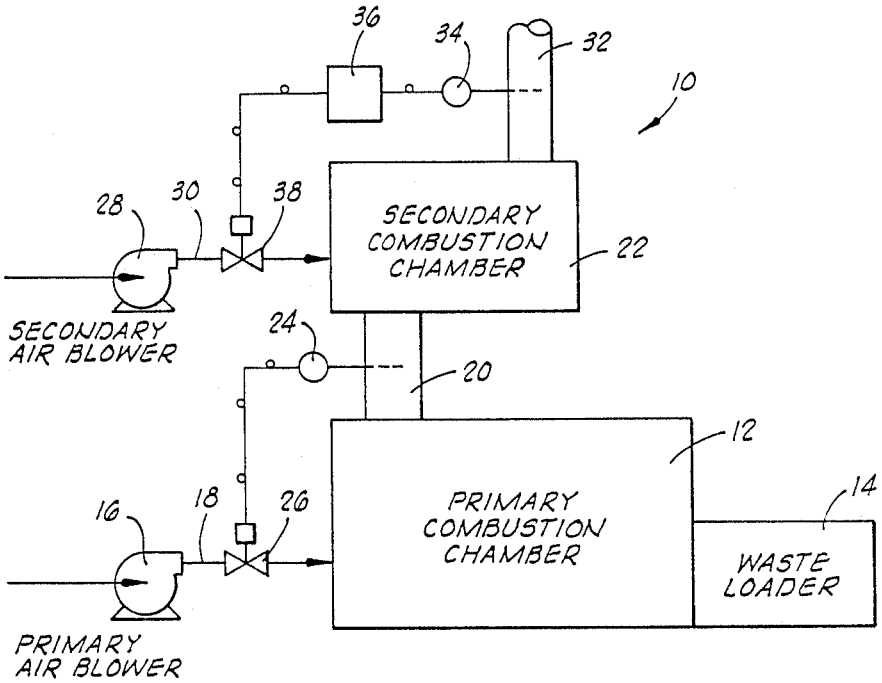
FIG. 1 is a schematic illustration of an incineration apparatus of the present invention.

Referring now to the drawings, and particularly to FIG. 1, an incinerator apparatus of the present invention generally designated by the numeral 10 is illustrated. The incinerator 10 is comprised of a primary combustion chamber 12 having a batch waste loader 14 connected thereto, i.e., the loader 14 connected to a waste inlet in the primary combustion chamber 12. The discharge connection of a primary air blower 16 is connected by a conduit 18 to an air inlet in the primary chamber 12, and a conduit 20 is connected to a combustion gases outlet in the primary combustion chamber 12. The conduit 20 conducts combustion gases from the primary combustion chamber 12 to the inlet connection of a secondary combustion chamber 22. A temperature controller 24 which senses the temperature of the combustion gases produced in the primary combustion chamber 12 and conducted to the secondary combustion chamber 22 by the conduit 20 is operably connected to the conduit 20 and to a primary air rate control valve 26 disposed in the conduit 18.

The discharge connection of a secondary air blower 28 is connected to an air inlet in the secondary combustion chamber 22 by a conduit 30. A stack or conduit 32 is connected to a combustion gases outlet in the secondary combustion chamber 22, and a secondary temperature controller 34 which senses the temperature of combustion gases withdrawn from the secondary combustion chamber 22 by way of the stack or conduit 32 is connected thereto. The secondary temperature controller 34 is operably connected to a controller 36 for adjusting the rate of secondary air in accordance with a predetermined timed sequence when required. Both the temperature controller 34 and controller 36 are operably connected to a secondary air rate control valve 38 disposed in the conduit 30.

In operation of the apparatus 10, successive batches of waste material are loaded by way of the waste loader 14 into the primary combustion chamber 12. Each waste batch is substochiometrically combusted with primary air in the primary combustion chamber. The primary air is introduced into the combustion chamber from the primary air blower 16 by way of the conduit 18 and air rate control valve 26 disposed therein. The combustion gases produced as a result of the substochiometric combustion of the waste batch are withdrawn from the primary combustion chamber 12 by way of the conduit 20 and conducted to the secondary combustion chamber 22.

The temperature of the combustion gases produced in the primary combustion chamber 12 and conducted to the secondary combustion chamber 22 is continuously sensed by the temperature controller 24 which opens and closes the primary air rate control valve 26 in accordance with changes in such temperature to maintain the combustion gases at a constant selected temperature level. The particular selected temperature level at which the temperature controller 24 is set depends upon the particular type of waste material being combusted within the primary combustion chamber. Generally, however, the selected temperature level of the partially combusted combustion gases produced in the primary combustion chamber is set at a temperature in the range of from about 1400° F. to about 1700° F.

Figure 2:
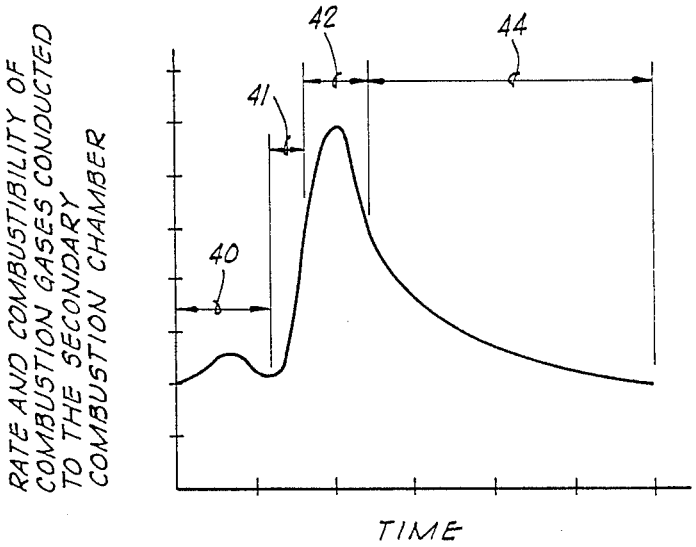
FIG. 2 is a graph illustrating the change in rate and combustibility of the combustion gases conducted to the secondary combustion zone over the time during which one batch of waste is incinerated.
Figure 9:
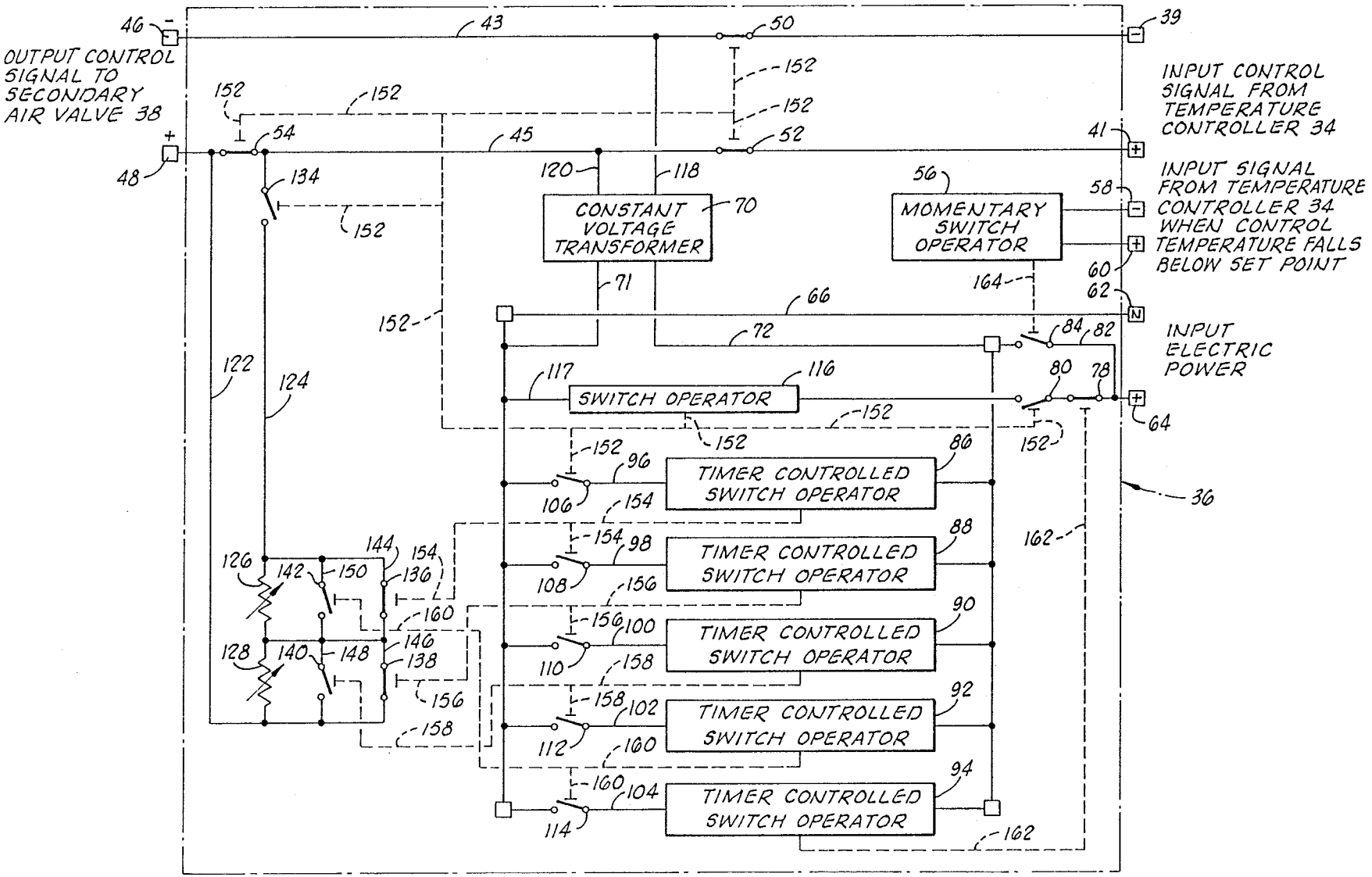

As shown by the graph presented in FIG. 2, during the time in which each batch of waste material is combusted in the primary combustion chamber 12 of the incinerator 10, the rate and combustibility of combustion gases produced and conducted to the secondary combustion chamber 22 increase to a maximum and then decline to a minimum. More specifically, when a batch of waste material is loaded into the primary combustion chamber 12 by the waste loader 14, the rate of combustion gases increases slightly and then decreases again during the loading time or stage 40. After the waste batch has been loaded, combustion of the batch takes place in an initial incineration stage 41 during which the rate and combustibility of combustion gases produced in the primary combustion chamber 12 and conducted to the secondary combustion chamber 22 increase to a level whereby the operating temperature of the secondary combustion chamber is reached. After reaching such operating temperature, the rate and combustibility of the combustion gases conducted to the secondary combustion chamber 22 reach a maximum and then decrease to a level just capable of sustaining the operating temperature in a peak incineration stage 42. During a final incineration stage 44, the rate and combustibility of the combustion gases conducted to the secondary combustion chamber 22 are too low to sustain the operating temperature and decrease to a minimum which exists prior to the loading of the next batch of waste material. As mentioned above and as will be understood by those skilled in the art, the operation described herein applies to an incinerator operated intermittently or otherwise whereby the selected operating temperature of the secondary combustion chamber is not continuously maintained.

The temperature controller 34 senses the temperature of the combustion gases produced in the secondary combustion chamber 22 which are withdrawn therefrom by way of the stack or conduit 32. During the peak incineration stage 42, the controller 34 controls the temperature of such combustion gases in accordance with temperature changes therein to maintain the temperature at a substantially constant selected operating temperature level, generally in the range of from about 1600° F. to about 2000° F. That is, during the loading stage 40 and the initial incineration stage 41, the temperature of the combustion gases produced in the secondary combustion chamber remains below the selected operating temperature set point of the temperature controller 34. When the set point temperature is reached, the temperature controller 34 controls the temperature at the set point. However, when the batch of waste material being combusted enters its final incineration stage 44 and the selected operating temperature of the combustion gases withdrawn from the secondary combustion chamber 22 can no longer be maintained, the controller 36 takes over the operation of the secondary air rate control valve 38 from the temperature controller 34 and controls the rate of secondary air introduced into the secondary combustion chamber 22. The controller 36 controls the secondary air rate in accordance with a predetermined timed sequence which is based on a simulation of the decline in the rate and combustibility of the combustion gases conducted to the secondary combustion zone 22 during the final incineration stage 44 of each waste batch and the increase in such rate and combustibility during the initial incineration stage 41. The controller 36 insures that the temperature of the combustion gases produced in the secondary combustion chamber 22 and withdrawn therefrom is maintained at a relatively high level without the formation of smoke. Further, the controller 36 provides sufficient secondary air to completely combust the partially combusted gases conducted to the secondary combustion chamber 22 without overcooling the gases thereby insuring the most efficient and economical operation of the incinerator apparatus 10.

Referring now to FIGS. 3 through 8, the controller 36 is illustrated schematically in various modes of operation. FIG. 3 illustrates the controller 36 in the standby mode which exists during the peak incineration stage 42 of each waste batch. The output control signal from the temperature controller 34, in the form of an electromotive force, is applied to input terminals 39 and 59 which are connected by leads 43 and 45 to control signal output terminals 46 and 48, respectively. The control signal output terminals 46 and 48 are connected to the electrically operated secondary air rate control valve 38 by appropriate wiring. Connected in the lead 43 is a normally closed switch 50, and connected in the lead 45 are normally closed switches 52 and 54. Thus, in the standby mode illustrated in FIG. 3, the control signal from the temperature controller 34 passes through the controller 36 to the secondary air rate control valve 38.

A momentary switch operator 56 is connected to a pair of input terminals 58 and 60 for receiving an input signal from the temperature controller 34 when the control temperature, i.e., the temperature of the combustion gases withdrawn from the secondary combustion chamber 22, falls below the selected operating temperature level set point.

Terminals 62 and 64 are provided to which input electric power for the controller 36 is applied. The terminal 62 is connected to a lead 66 which is in turn connected to a bus 68. The terminal 64 is connected by a lead 74 to a second bus 76. The lead 74 contains a normally closed switch 78 and a normally open switch 80. A lead 82 bypassing the switches 78 and 80 and containing a normally open switch 84 is connected between the terminal 64 and the bus 76.

Electrically activated adjustable timer controlled switch operators 86, 88, 90, 92 and 94 are connected between the buses 68 and 76 by leads 96, 98, 100, 102 and 104, respectively. Normally open switches 106, 108, 110, 112 and 114 are disposed within the leads 96, 98, 100, 102 and 104, respectively. A switch operator 116 is also provided connected between the buses 68 and 76 by a lead 117. An adjustable constant voltage transformer 70 is connected to the buses 68 and 76 by leads 71 and 72, respectively. The output from the transformer 70 is connected to the leads 43 and 45 by leads 118 and 120, respectively.

A pair of leads 122 and 124 connected to the lead 45 on opposite sides of the switch 54 is connected to two serially connected adjustable resistors 126 and 128. A normally open switch 134 is disposed in the lead 124, and normally closed switches 136 and 138 are disposed in circuits provided by leads 144 and 146 individually bypassing the resistors 126 and 128, respectively. Normally open switches 140 and 142 are disposed in leads 148 and 150 which also bypass the resistors 128 and 126, respectively.

As indicated by the connected dashed lines 152, the switch operator 116 controls the operation of the switches 80, 106, 134, 54, 52 and 50. As indicated by the connected dashed lines 154, the timer controlled switch operator 86 operates the switches 108 and 136. As indicated by the connected dashed lines 156, the timer controlled switch operator 88 operates the switches 110 and 138. As indicated by the connected dashed lines 158, the timer controlled switch operator 90 operates the switches 112 and 140. As indicated by the connected dashed lines 160, the timer controlled switch operator 92 operates the switches 114 and 142, and as indicated by the dashed lines 162, the timer controlled switch operator 94 operates the switch 78. The momentary switch operator 56 operates the switch 84 as indicated by the dashed line 164.

Figure 4:
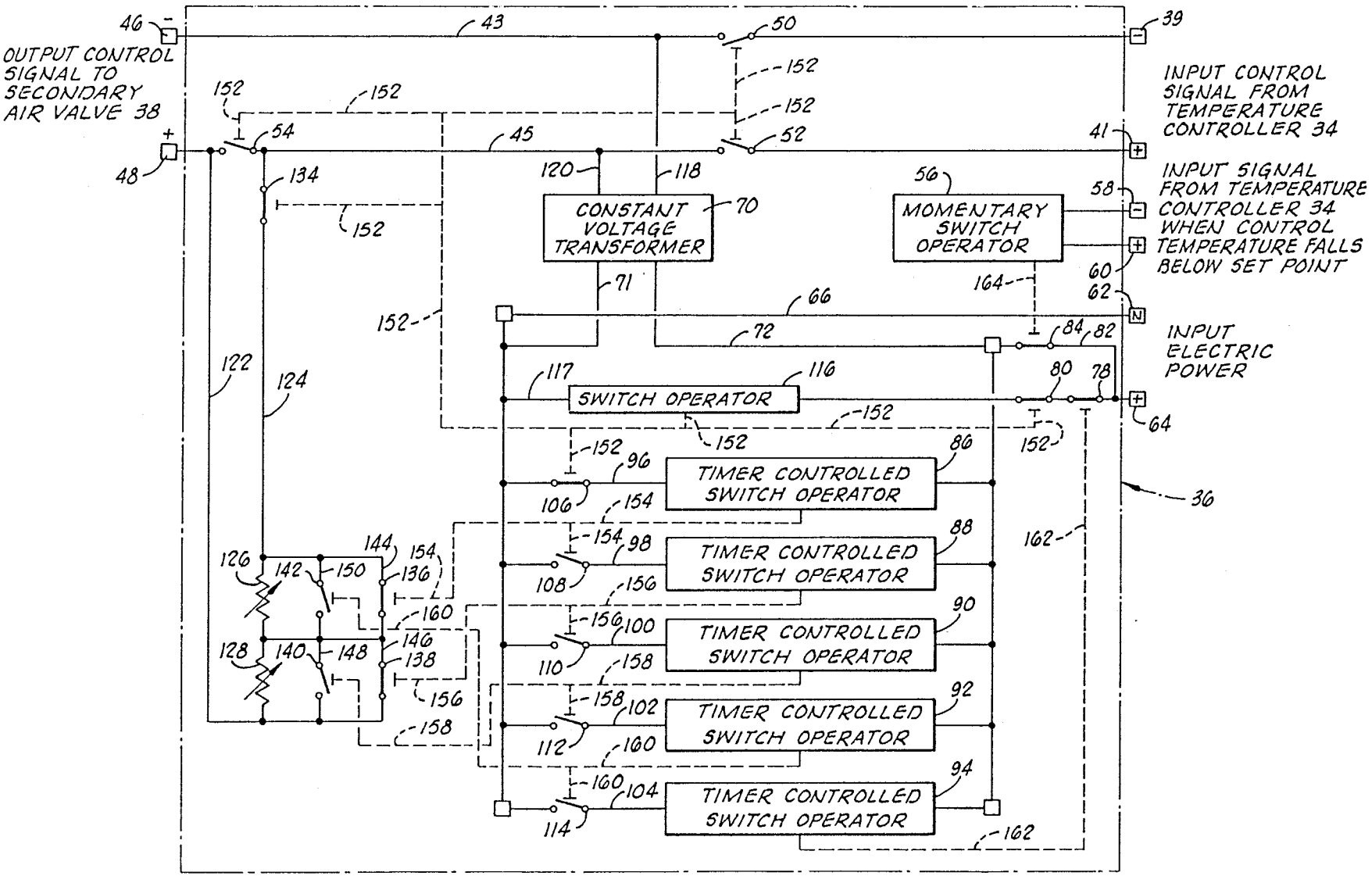

Referring now to FIG. 4, the controller 36 is illustrated after an input signal from the temperature controller 34 is applied to the terminals 58 and 60. The input signal is generated or caused to be generated by the temperature controller 34 when the control temperature, i.e., the temperature of the combustion gases withdrawn from the secondary combustion chamber 22, falls below the selected set point operating temperature. The input signal applied to the terminals 58 and 60 causes the momentary switch operator to momentarily close the switch 84 which in turn completes a circuit between the buses 68 and 76 to the switch operator 116 by way of the lead 117. The switch operator 116 closes the switches 80, 106 and 134 and opens the switches 54, 52 and 50. The closing of the switch 80 energizes the bus 76 by way of the lead 74 so that it remains energized after the momentary switch 84 reopens. The closure of the switch 106 completes a circuit to the timer controlled switch operator 86 by way of the lead 96 connected between the buses 68 and 76 activating the timer thereof. The closure of the switch 134 completes a circuit around the opened switch 54 through the leads 122 and 124, and through the closed switches 136 and 138 by way of the leads 144 and 146, respectively. The opening of the switches 50 and 52 causes the input control signal from the temperature controller 34 to be cut off.

The energizing of the buses 68 and 76 causes the adjustable constant voltage transformer 70 to be energized by way of the leads 71 and 72 connected thereto. The output from the transformer 70 is applied to the terminals 46 and 48 and to the operator of the secondary air rate control valve 38. That is, the terminal 46 is connected to one side of the transformer 70 by way of the leads 118 and 43, and the terminal 48 is connected to the other side by way of the lead 120, the lead 45, the closed switch 134, the lead 124, the leads 144 and 146, the closed switches 136 and 138, and the lead 122. The output of the transformer 70 is selected at a voltage level whereby the secondary air rate control valve 38 is positioned to allow the desired rate of air to be introduced into the secondary combustion chamber 22 during a beginning portion of the final incineration stage 44 of each waste batch. That rate of air is introduced into the secondary combustion chamber for an initial portion of the final incineration stage 44, i.e., for the time period at which the timer of the timer controlled switch operator 86 is set.

Figure 5:
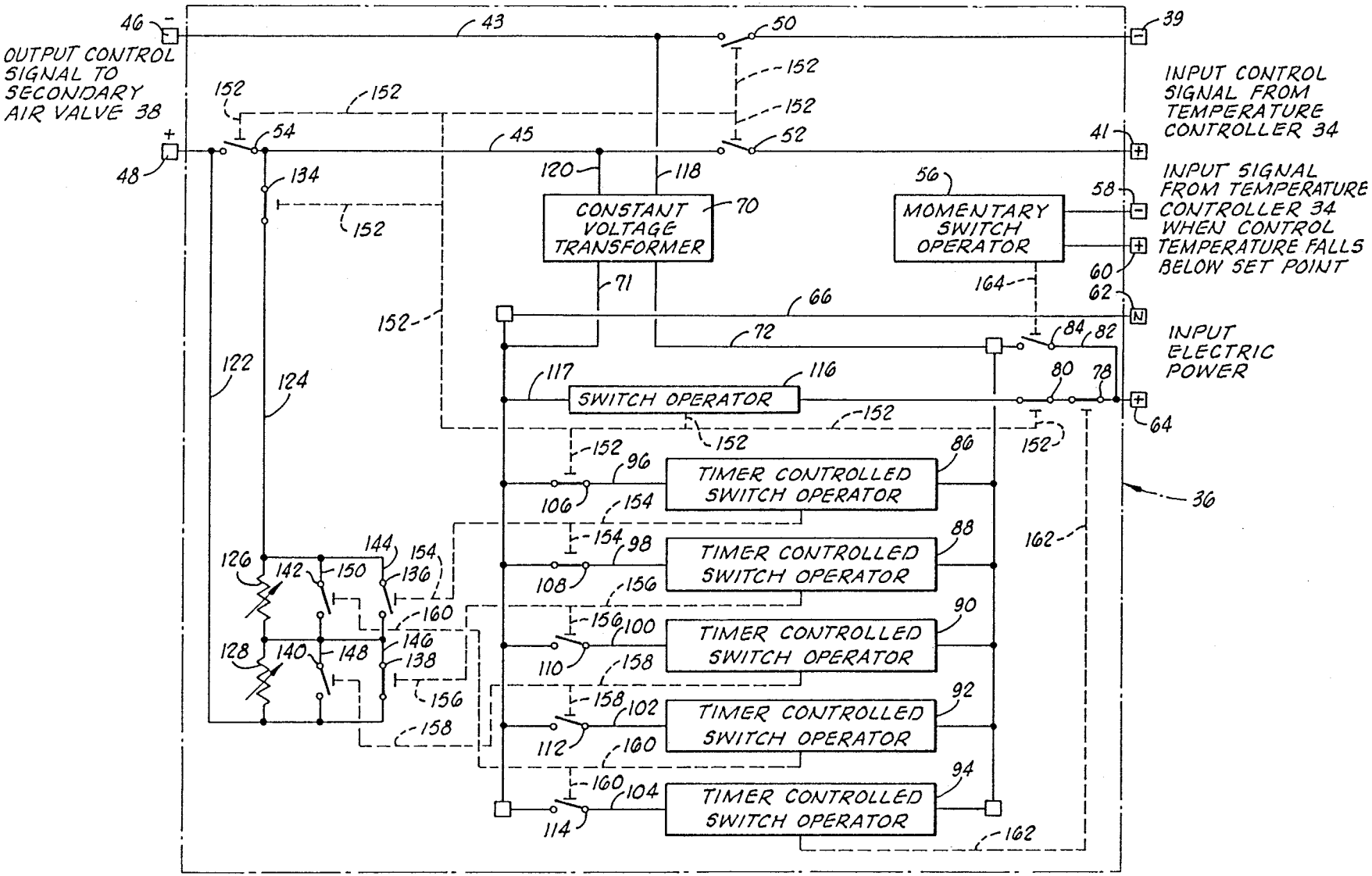
Figure 9:
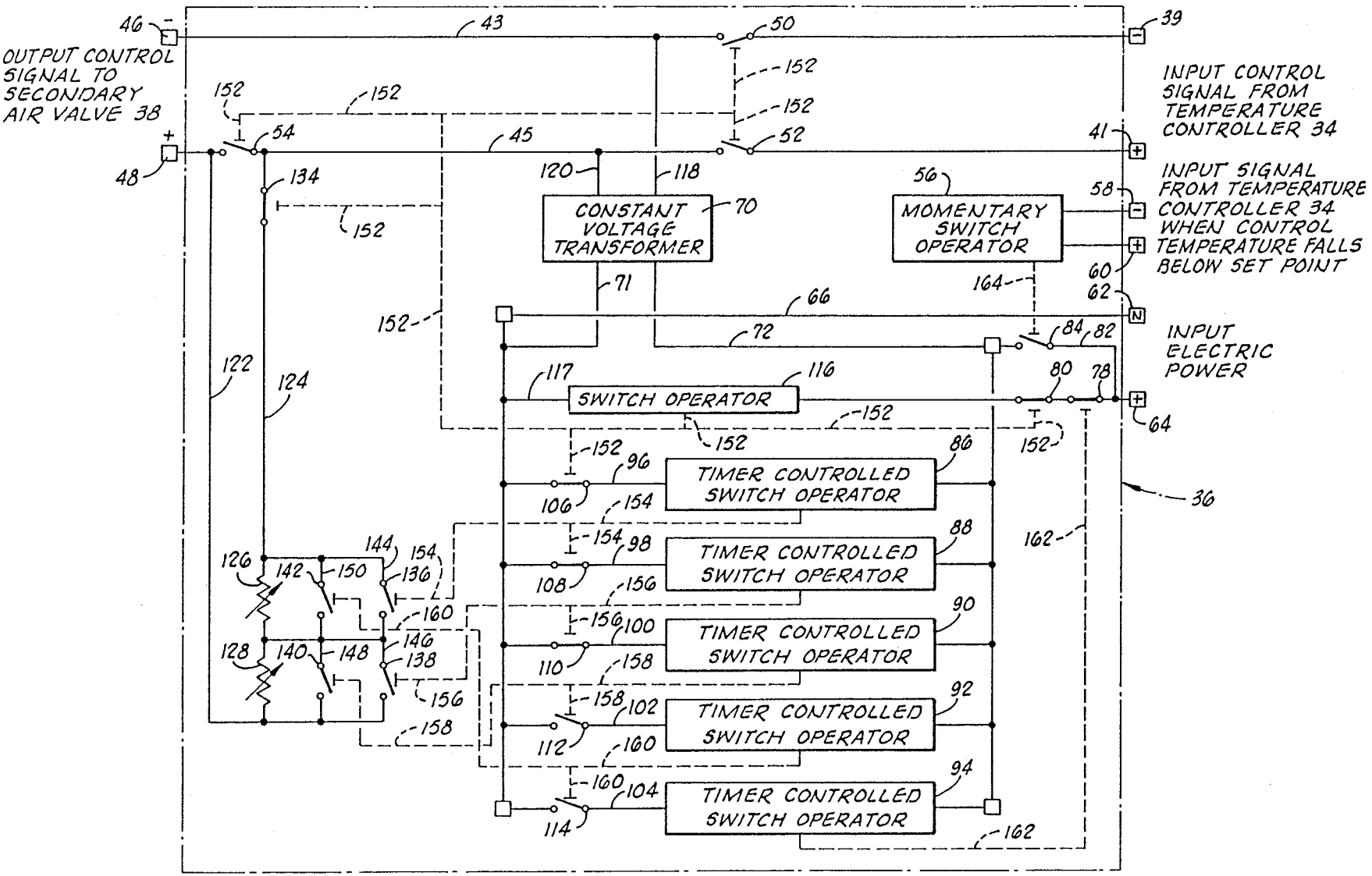

Referring now to FIG. 5, at the end of the set time, the timer controlled switch operator 86 closes the switch 108 which activates the timer of the timer controlled switch operator 88, and opens the switch 136 placing the adjustable resistor 126 in the circuit connecting the constant voltage transformer 70 to the terminal 48. Thus, when the controller 36 changes to the mode illustrated in FIG. 5, the signal transmitted to the secondary air rate control valve 38 by way of the terminals 46 and 48 is changed as a result of the resistor 126 being placed in the circuit which in turn closes the valve 38 an incremental amount and reduces the secondary air rate to a lower level during an additional portion of the final incineration stage 44 of each waste batch.

Figure 7:
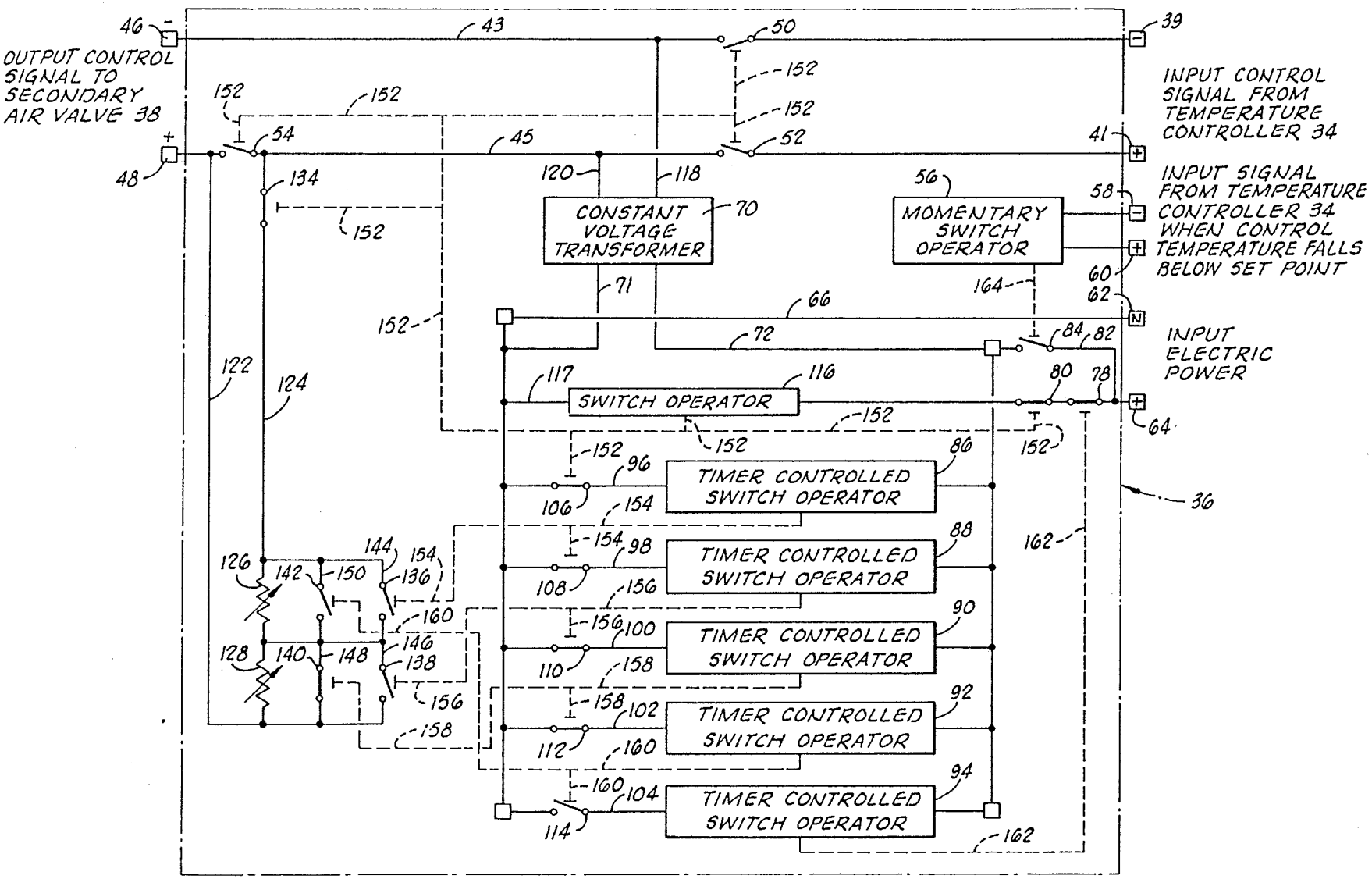

Referring to FIG. 6, when the timer of the timer controlled switch operator 88 runs out, the switch operator closes the switch 110 and opens the switch 138 causing the timer of the timer controlled switch operator 90 to be activated, and placing the resistor 128 in the output control signal circuit. The placing of the resistor 128 in the output control signal circuit changes the control signal and closes the secondary air rate control valve 38 an additional incremental amount reducing the secondary air rate to yet a lower level during the latter portion of the final incineration stage 44 and the loading stage 40. Referring to FIG. 7, when the timer of the timer controlled switch operator 90 runs out, the switch 112 is closed activating the timer controlled switch operator 92, and the switch 140 is closed which bypasses the resistor 128 and opens the secondary air rate control valve 38 an incremental amount, thereby increasing the secondary air rate during an initial portion of the initial incineration stage 41.

Figure 8:
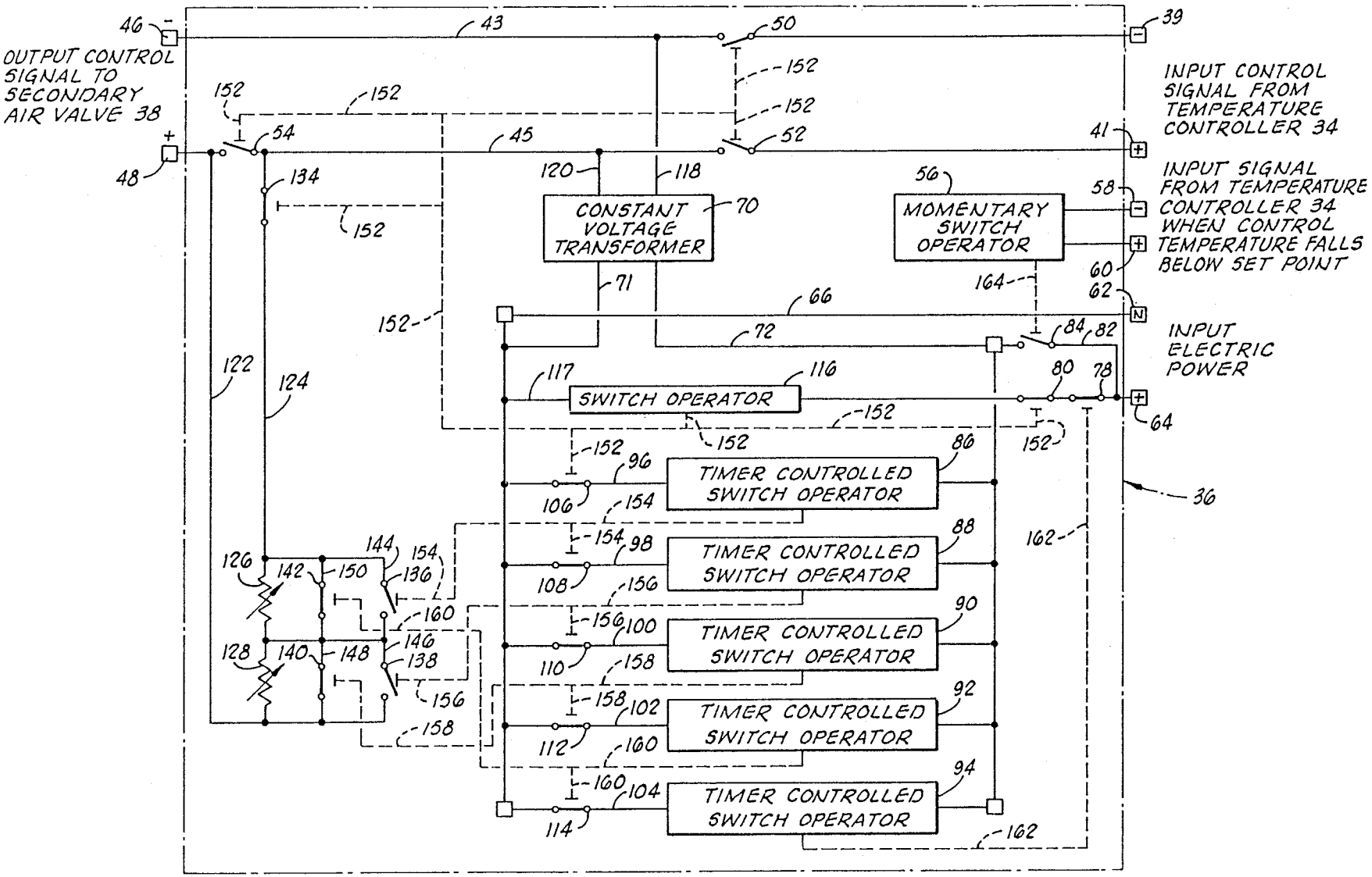

Referring to FIG. 8, when the timer of the timer controlled switch operator 92 runs out, the switch 114 is closed thereby activating the timer controlled switch operator 94, and the switch 142 is closed causing the resistor 126 to be bypassed and the secondary air rate control valve to be opened a further incremental amount, thereby increasing the secondary air rate during the latter portion of the initial incineration stage 41. When the timer of the timer controlled switch operator 94 runs out, the switch 78 is opened which breaks the circuit to the bus 76 whereby the switch operator 116 is deactivated and the controller 36 returns to the standby mode as shown in FIG. 3.

Thus, when the incineration of each waste batch enters the final incineration stage 44 as a result of the temperature of the combustion gases withdrawn from the secondary combustion chamber 22 falling below the set point temperature of the temperature controller 34, an input signal is applied to the controller 36 which causes the controller 36 to take over the operation of the secondary air rate control valve 38. The controller 36 reduces the rate of secondary air introduced into and combined with the combustion gases in the secondary combustion zone 22 during the final incineration stage 44 in accordance with a predetermined timed sequence which is based on a simulation of the decline in the rate and combustibility of the combustion gases conducted to the secondary combustion zone 22. Accordingly, the secondary air rate control valve 38 is incrementally closed over the duration of the final incineration stage 44 and maintains a low air rate during loading stage 40. The controller 36 then increases the secondary air rate during the initial incineration stage 41 of each waste batch in accordance with a predetermined timed sequence which is based on a simulation of the increase in the rate and combustibility of the combustion gases conducted to the secondary combustion zone 22 during the initial incineration stage 41.

The particular closure and opening sequences followed by the controller 36 are pre-set using a trial and error technique to achieve as high an overall temperature level for the combustion gases withdrawn from the secondary combustion chamber 22 as possible or desired while still preventing the formation of smoke. The closure and opening sequences are changed by adjusting the voltage output of the transformer 70, adjusting the timers of the timer controlled switch operators 86, 88, 90, 92 and 94 and adjusting the resistances of the variable resistors 126 and 128. As will be understood by those skilled in the art, additional timer controlled switch operators, switches and variable resistors can be utilized as desired in the controller 36 to more closely control the decrease and increase in the secondary air rate.

In order to further illustrate the method and apparatus of the present invention, the following example is given.

EXAMPLE

Successive batches of waste in an amount of 100 lbs/batch are loaded by the loader 14 into the primary combustion chamber 12 every 10 minutes. The loading time for each batch is 1.5 minutes, the initial incineration stage 41 for each batch is 1.5 minutes, the peak incineration stage 42 for each batch is 2.0 minutes and the final incineration stage 44 for each batch is 5 minutes. The temperature controller 24 is set at a selected operating temperature level of 1400° F., and the rate of combustion gases conducted to the secondary combustion chamber 22 from the primary combustion chamber 12 varies from a minimum of about 1 scf./sec. to a maximum of about 2.5 scf./sec.

The secondary temperature controller 34 is set at a selected operating temperature level of 1800° F., secondary air is introduced into the secondary combustion chamber 22 at a rate varying from about 1 scf./sec. to about 2.5 scf./sec. during the peak incineration stage of each batch. During the loading stage, the initial incineration stage and the final incineration stage, when the temperature of the combustion gases withdrawn from the secondary combustion chamber by way of the conduit 32 is below the set point of 1800° F., the controller 36 is activated.

The controller 36 controls the rate of secondary air introduced into the secondary combustion chamber 22 from a minimum of 1 scf./sec. to a maximum of 2.5 scf./sec. during the initial and peak incineration stages 41 and 42 of each waste batch and from about 2.0 scf./sec. to a minimum of about 1 scf./sec. over a time period of about 5 minutes during the final incineration stage 44 of each waste batch. Complete combustion of the combustion gases in the secondary combustion chamber 22 takes place during the incineration of each batch and no smoke, fumes or odors are produced.

What is claimed is:

1. In a method of incinerating successive batches of waste material wherein each batch is introduced into a primary combustion zone and substochiometrically combusted with primary air introduced therein, the combustion gases produced in the primary combustion zone are conducted to a secondary combustion zone wherein they are combined with secondary air and further combusted and the resulting combustion gases are withdrawn from said secondary combustion zone, the improvement comprising: during the peak incineration stage of each batch, controlling the rate of secondary air combined with said combustion gases conducted to said secondary combustion zone in accordance with changes in the temperature of the combustion gases withdrawn therefrom whereby said temperature is maintained at a substantially constant selected temperature level; and during the loading, initial and final incineration stages of each batch when said selected temperature level cannot be maintained as a result of the rate and combustibility of said combustion gases conducted to said secondary combustion zone being too low, controlling the rate of secondary air combined with said combustion gases in accordance with a predetermined timed sequence which simulates the increase and decline in the rate and combustibility of the combustion gases conducted to said secondary combustion zone during the loading, initial and final incineration stages whereby the average temperature of the combustion gases withdrawn from said secondary combustion zone is maintained at a relatively high level, but the formation of smoke is prevented.

2. The method of claim 1 wherein the rate of primary air introduced into said primary combustion zone is controlled in accordance with changes in the temperature of the combustion gases conducted to said secondary combustion zone whereby said temperature is maintained at a substantially constant selected level.

3. The method of claim 2 wherein said selected temperature level of the combustion gases conducted to said secondary combustion zone is in the range of from about 1400° F. to about 1700° F.

4. The method of claim 3 wherein said selected temperature level of the combustion gases withdrawn from said secondary combustion zone is in the range of from about 1600° F. to about 2000° F.

5. The method of claim 4 wherein said combustion gases withdrawn from said secondary combustion zone are utilized as a heat source.

6. A method of intermittently incinerating successive batches of waste material comprising the steps of:

introducing each of said batches into a primary combustion zone;

substochiometrically combusting said batch within said primary combustion zone with primary air introduced thereinto;

controlling the rate of said primary air introduced into said primary combustion zone in accordance with changes in the temperature of the combustion gases produced therein whereby said temperature is maintained at a substantially constant selected level;

conducting said combustion gases into a secondary combustion zone;

combusting said combustion gases further in said secondary combustion zone by combining secondary air therewith;

during the peak incineration stage of each batch, controlling the rate of secondary air combined with said combustion gases in said secondary combustion zone in accordance with changes in the temperature of the combustion gases produced therein whereby said temperature is maintained at a substantially constant selected operating temperature level; and during the loading, initial and final incineration stages of each batch when said selected temperature level cannot be maintained as a result of the rate and combustibility of the combustion gases conducted to said secondary combustion zone being too low, controlling said rate of secondary air combined with said combustion gases in said secondary combustion zone in accordance with a predetermined timed sequence which simulates the increase and decline in the rate and combustibility of the combustion gases conducted to said secondary combustion zone during the loading, initial and final incineration stages whereby the average temperature of the combustion gases produced in said secondary combustion zone is maintained at a relatively high level, but the formation of smoke is prevented.

7. The method of claim 6 wherein said selected temperature level of combustion gases produced in said primary combustion zone is in the range of from about 1400° F to about 1700° F.

8. The method of claim 7 wherein said selected temperature level of said combustion gases produced in said secondary combustion zone is in the range of from about 1600° F. to about 2000° F.

9. The method of claim 8 wherein said combustion gases produced in said secondary combustion zone are utilized as a heat source.

10. Apparatus for incinerating successive batches of waste material comprising:

a primary combustion chamber having a waste material inlet, an air inlet and a combustion gases outlet;

means for loading successive batches of waste material into said primary combustion chamber connected to the waste material inlet thereof;

means for introducing primary air into said primary combustion chamber connected to the air inlet thereof;

means for controlling the rate of air introduced into said primary combustion chamber in accordance with changes in the temperature of the combustion gases produced therewithin and maintaining said temperature at a substantially constant selected level connected to said primary air introducing means and to said primary combustion chamber;

a secondary combustion chamber having a combustion gases inlet connected to the combustion gases outlet of said primary combustion chamber, an air inlet and a combustion gases outlet;

means for introducing secondary air into said secondary combustion chamber connected to the air inlet thereof;

first control means for controlling the rate of secondary air introduced into said secondary combustion chamber in accordance with changes in the temperature of combustion gases produced therein whereby said temperature is maintained at a substantially constant selected temperature level during the peak incineration stage of each batch of waste material, said first control means being connected to said secondary air introducing means and to said secondary combustion chamber; and second control means for controlling the rate of secondary air introduced into said secondary combustion chamber in accordance with a predetermined timed sequence which simulates the increase and decline in the rate and combustibility of combustion gases conducted to said secondary combustion chamber during the loading, initial and final incineration stages of each batch when said selected temperature level cannot be maintained as a result of the rate and combustibility of said combustion gases conducted to said secondary combustion zone being too low whereby the temperature level of the combustion gases produced in said secondary combustion chamber is maintained at a relatively high temperature level, but the formation of smoke is prevented, said second control means being connected to said secondary air introducing means and to said secondary combustion chamber.

11. The apparatus of claim 10 wherein said means for introducing primary air into said primary combustion chamber comprise a primary air blower.

12. The apparatus of claim 11 wherein said means for controlling the rate of primary air introduced into said primary combustion chamber in accordance with changes in the temperature of the combustion gases produced therein are comprised of a control valve disposed between said primary air blower and said primary combustion chamber and a temperature controller operably connected to said control valve and to said primary combustion chamber.

13. The apparatus of claim 12 wherein said means for introducing secondary air into said secondary combustion chamber comprise a secondary air blower.

14. The apparatus of claim 13 wherein said first control means for controlling the rate of secondary air introduced into said secondary combustion chamber are comprised of a secondary air rate control valve disposed between said secondary air blower and said secondary combustion chamber and a secondary temperature controller operably connected to said secondary control valve and to said secondary combustion chamber.

15. The apparatus of claim 14 wherein said second control means for controlling the rate of air introduced into said secondary combustion chamber are comprised of said secondary control valve and electronic means for selectively incrementally opening and closing said secondary control valve over a selected time period.

* * * * *